US005758807A

United States Patent [19]

Wright

[11] Patent Number: 5,758,807

[45] Date of Patent: Jun. 2, 1998

[54] POCKETLESS SCREW HOLDER

[76] Inventor: Robert A. Wright, 6 Cedar Trail, Kinnelon, N.J. 07405

[21] Appl. No.: 697,202

[22] Filed: Aug. 21, 1996

[51] Int. Cl.[6] ..... A45F 5/00

[52] U.S. Cl. ..... 224/183

[58] Field of Search ..... 224/183, 904

[56] References Cited

U.S. PATENT DOCUMENTS

| | | | |
|---|---|---|---|
| 3,886,508 | 5/1975 | Lavrard | 224/183 X |
| 4,736,877 | 4/1988 | Clark | 224/183 X |
| 4,826,059 | 5/1989 | Bosch et al. | 224/183 |
| 5,025,966 | 6/1991 | Potter | 224/183 |
| 5,056,661 | 10/1991 | Balzano | 224/183 X |
| 5,213,240 | 5/1993 | Dietz et al. | 224/183 |
| 5,593,073 | 1/1997 | Finnegan | 224/183 |

FOREIGN PATENT DOCUMENTS

| | | | |
|---|---|---|---|
| 2562152 | 12/1985 | France | 224/183 |

*Primary Examiner*—Renee S. Luebke

*Attorney, Agent, or Firm*—Lerner, David, Littenberg, Krumholz & Mentlik

[57] ABSTRACT

A device for holding fasteners or small tools includes no pocket or pouch in which a craftsman must reach in order to select a fastener or tool. The pocketless device holds the fasteners or small tools in an open arrangement, openly accessible to the working craftsman. A magnet can be attached to a substrate, which can be independent of a portion of a work belt or ladder or workbench, and metal fasteners are held thereto by the magnetic forces of the magnet transmitted by the magnet.

8 Claims, 1 Drawing Sheet

POCKETLESS SCREW HOLDER

BACKGROUND OF THE INVENTION

The present invention is directed generally to a device for holding screws, nails or even tools and more specifically to a device for holding such items in an open manner so that a craftsman can more conveniently and quickly locate and remove any such item from the holder.

In the construction and maintenance trades, craftsmen using fasteners (such as self-tapping screws, sheet rock screws, nails, staples, etc.) or small tools (such as screw bits, nut drivers, etc.) or even larger tools require quick access to such items when in the middle of a job or specific task. For instance, a craftsman may be on a ladder installing metal ductwork and that craftsman will require a self-tapping screw. It is likely that he will be using several self-tapping screws and will be repeatedly reaching for such screws while holding a portion of the ductwork and/or his screw gun. Whether it is an electrician using staples or a roofing contractor using nails, the same problem will arise.

Screws, other fasteners and tools are normally held in pouches hung from a work belt or in a container (which can be set on the ladder). However, the top rim of the pouch, usually made of leather, may fold against the body of the craftsman and close the opening to the pouch (or the pouch opening could otherwise close), thereby requiring the craftsman to shift his body from the position he is in when he requires a screw or other fastener, and to manipulate the pouch opening so that he can reach into it and locate a screw. This movement and manipulation of the pouch slows the job and is frustrating to the craftsman. Moreover, when he finally reaches into the pouch, his fingers may be pricked by the points of the screws, particularly in the case of self-tapping screws or sheet rock screws. Certainly, the craftsman's fingers will become irritated by the repeated selection of screws.

The present invention provides a more convenient manner of holding screws, nails or other fasteners, or even other tools. This is accomplished by providing open access to the fasteners.

SUMMARY AND OBJECTS OF THE INVENTION

It is an object of the present invention to provide a convenient holder for screws, nails, other fasteners, small tools, or any other items that might be used repeatedly by a craftsman in his work.

It is another object of the present invention to provide a holder for screws, fasteners and small tools by providing a holder which can be associated with, part of or independent of a tool belt.

It is another object of the present invention to provide a holder which can be used by the craftsman during his work, and may also be hung in one's truck, on a ladder, etc.

The above and other objects of the present invention, which will become apparent from the following, can be accomplished by providing a pocketless device for holding fasteners accessible to a working craftsman, which device includes a substantially thin substrate, means for securing said substrate in a location conveniently accessible to a working craftsman, and means for holding metal fasteners to the substrate, the holding means also being substantially thin and being made of a material which can hold fasteners in a substantially vertical position such that the fasteners are in an open arrangement and openly accessible to the working craftsman.

BRIEF DESCRIPTION OF THE DRAWINGS

The above and other objects of the present invention will become apparent, as will a better understanding of the concepts underlying the present invention, by reference to the description which follows and refers to the accompanying drawings in which.

DETAILED DESCRIPTION

Figure 1:
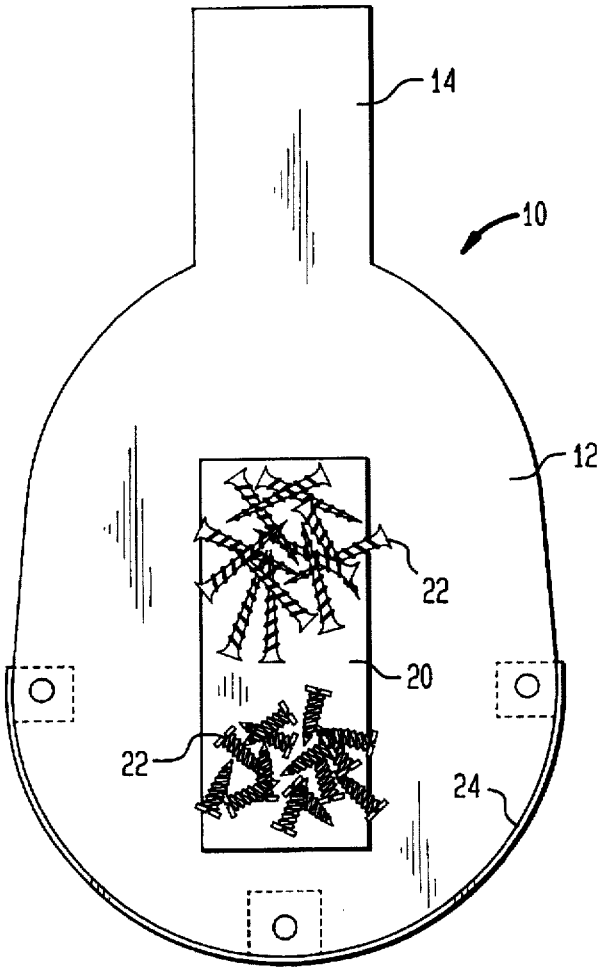
FIG. 1 is a front elevational view of a pocketless screw holder in accordance with the present invention.
Figure 2:
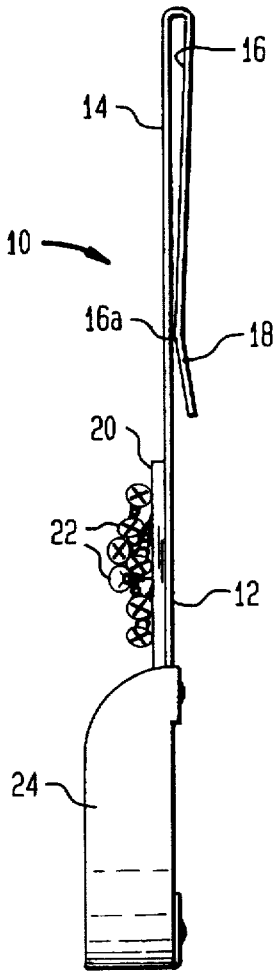
FIG. 2 is a right side elevational view of the pocketless screw holder shown in FIG. 1.

Referring to FIG. 1, the pocketless device is generally designated as 10 in accordance with the present invention. The pocketless screw holder as depicted in FIGS. 1 and 2 includes a substrate 12 which is substantially thin and can be made of any suitable material. (The substrate may be part of a tool belt pouch or any other member.) Polyvinylchloride or any other plastic material are sufficient as they are suitably strong and durable yet somewhat flexible, which may be preferred. Leather is another choice of acceptable material, particularly in the trades. The shape of the substrate is of no particular import to the invention herein. However, particularly where the substrate is not part of a tool belt, pouch or ladder (as explained below), the substrate should not be overly large so as to be cumbersome when worn by a craftsman. In the illustrated embodiment, a somewhat trapezoidal shape with generously rounded corners is provided, and the substrate is approximately 4 to 5 inches long (from top to bottom) and approximately 4 inches wide (from side to side). In thickness, the plastic substrate 12 may be about one sixteenth of an inch, but of course may vary from such thickness.

The pocketless screw holder 10 also includes a hanger portion 14 which, in the embodiment illustrated, is not as wide as the substrate 12. Because the hanger portion 14 is thinner than the substrate 12, and relatively narrow as a general matter (1–1½ inches), it will not be in the way of the craftsman. In this regard, the hanger portion 14 is the portion which goes over the belt and if it were wider it would cause the entire tool holder to shift as the craftsman moves.

The hanger portion 14 is associated with a clip member 16. In the illustrated embodiment, the clip member 16 and hanger portion 14 cooperate with one another to hang the pocketless screw holder 10 on a craftsman's belt, on a ladder, a work truck (for instance in an opening on the back door of a van), or any other place where the pocketless screw holder 10 might be used or stored. In the illustrated embodiment, hanger portion 14 and clip member 16 are integrally connected by an integral hinge which maintains the clip portion 16 in a normally closed or substantially closed position. The clip member 16 may be in a position that it must be moved away from hanger portion 14 when being placed over a belt or any other member. Indeed, as shown in FIG. 2, the clip member 16 includes a curved portion 18 to facilitate securement of the pocketless screw holder 10 to a belt or other member since it will facilitate the exertion of the clipping or compression forces.

Of course, it may suffice to simply have hanger portion 14 and clip member 16 spaced sufficiently so that the pocketless screw holder 10 simply "hangs" from the belt and does not exert any clipping forces to facilitate the securement of the pocketless screw holder 10 to the belt (or any other member).

In addition, the hanger portion 14 need not have an associated clip member 16, but rather may have openings therein so that a belt can be looped through the openings and the pocketless screw holder 10 can hang therefrom.

The pocketless screw holder 10 includes a magnet 20, which in the illustrated embodiment is a thin rectangular-shaped magnet. The magnet is attached to the substrate 12 by any suitable means (including mechanical fasteners, sewn thread, tape, adhesive, etc.), even if it is removably secured to the substrate 12 by a mechanical hook and loop fastener, tape over the top of it, double-backed tape, etc. (though the securement must be sufficient that it will not fall off during use). The magnet 20 is illustrated in a rectangular shape which is arranged with its long sides in a vertical position. Of course, virtually any shape and arrangement will suffice. For instance, the rectangular magnet 20 could be arranged so that its long sides are horizontal.

The strength of the magnet (i.e., the magnetic forces it exhibits) can vary depending upon the items to be held on it. Clearly, for larger tools, such as hammers which might be held on a ladder, a stronger magnet should be used.

The screws 22 illustrated in the drawings remain removably attached to the magnet 20 because they are made of metal. The magnetic forces permit the stacking of screws one on top of the other so that a thickness of screws can be held on the pocketless screw holder 10 at any given time. This enables the craftsman to hold many screws in an open arrangement such that they are conveniently accessible to the craftsman.

It is noted that the screws illustrated in the figures are generally of two types, the longer screw being a sheet rock screw with a sharp point and sharp threads, and the shorter screw being a self-tapping screw having a sharp point to facilitate the self-tapping feature. Both types of screws, if held in pouches, tend to irritate the craftsman's hands as he repeatedly reaches into the pouch and selects a screw.

The use of a magnet is particularly advantageous in connection with the present invention. However, it is not the only means by which fasteners, tools or other small items might be held in an open matter. Non-curing adhesives, hook and loop fasteners (one side of same) or similar materials might be used. Of course, a magnet has the advantage of facilitating the stacking of fasteners since the magnetic forces will be transmitted through underlying layers of fasteners.

Also, the magnet 20 can be of any suitable shape or size, or may even be split into two or more pieces so that different types of fasteners might be held on different magnets on the same substrate 12. See FIG. 3 which shows sheet rock screws on one side and self-tapping screws on the other.

FIGS. 1 and 2 also illustrate a shelf 24 which is arranged on the bottom side of the substrate and extends upwardly along the sides of the substrate. As illustrated, the shelf 24 is a separate piece which is riveted to the substrate 12 at three points. Of course, it may be connected to the substrate 12 by any suitable means, or may be integrally formed with the substrate 12. Also, although the shelf 24 extends upwardly along the sides of substrate 12, the degree to which it extends upwardly may be varied or may not extend upwardly at all. The flange must be constructed and arranged to serve the purpose described below.

The purpose of the shelf 24 is to catch and retain any screws which might fall, primarily when the craftsman selects and removes a screw since another screw might initially remain with the screw being selected and once the magnetic forces cease to hold the second screw, that second screw might fall. The shelf 24 might also help catch a screw which falls while the craftsman is moving and inadvertently brushes an object which pulls some of the screws loose from the magnet 20.

As an alternative to the shelf 24 illustrated in FIGS. 1 and 2, by way of example, another arrangement which would serve the above purpose is providing a shelf which is arranged only at the central bottom area of the substrate 12, below the area that is encompassed by the magnet 20 (i.e., the area in which the screws or other items will be held). That shelf (or the other shelf, including shelf 24) could have a magnet on itself to help hold screws or other items that would fall. The shelf could also include an upwardly extending flange which would be roughly parallel to the substrate 12. This could also help maintain any screws or other items which fall from the magnet 20.

Figure 3:
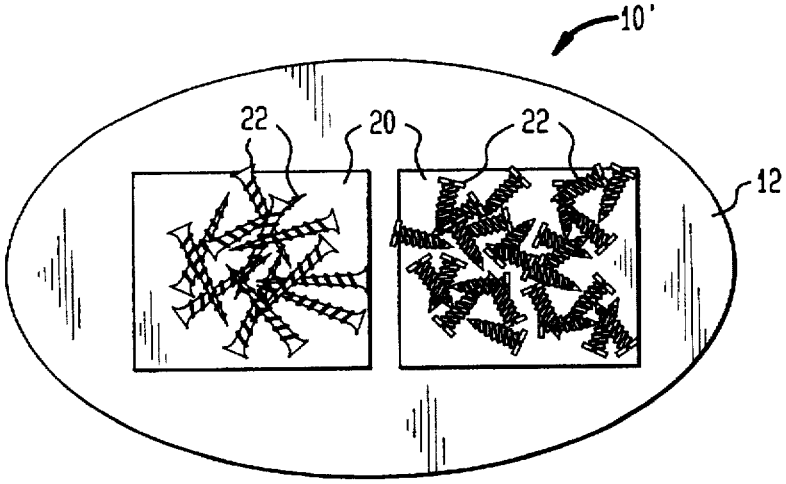
FIG. 3 is a front elevational view of another embodiment of a pocketless screw holder in accordance with the present invention.
Figure 4:
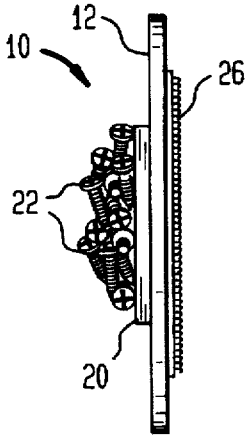
FIG. 4 is a right side elevational view of the pocketless screw holder shown in FIG. 3.

In another embodiment of the present invention, illustrated as 10' in FIGS. 3 and 4, the substrate 12 is in the shape of an oval, but again can be of any suitable shape. Also, the magnet 20 is arranged lengthwise within the oval shaped substrate 12. This embodiment of the pocketless screw holder 10' does not include a hanger portion 14 and clip member 16, but instead a fastener 26, illustrated as a hook and loop mechanical fastening material such as that sold under the mark VELCRO. Fastener 26 can be any suitable fastener, even including screws or the like to permanently fasten the substrate 12 to another member. However, in the case of hook and loop mechanical fastening materials, and other similar materials, the pocketless screw holder 10' can be removable. The other side of the fastening material can be provided on a tool belt, on the outside of a tool belt pouch, on a workbench, in a work truck, on a ladder, etc. Indeed, such material can be placed in a number of locations so that the tool holder can be moved (for storage or use). It should also be recognized that the fastener such as fastener 26 may be directly on a magnet such as magnet 20, rather than the magnet 20 being mounted on a substrate 12. The substrate 12, however, provides in many instances more rigidity than a magnet alone.

Indeed, if the substrate on or with which the screw holder is to be held or associated is made of metal, no fastener such as a fastener 26 is required at all. In such a case, the screw holder might simply be a magnet without the substrate 12, and may simply be a magnet which will be maintained on the metal substrate in a removable manner. In such a case, as well as in the case where the magnet is secured to a work pouch without a substrate 12, the work pouch or the other metal surface will operate as the substrate.

Accordingly, in use, the pocketless screw holder can be hung from a belt while a craftsman is working and the craftsman can simply reach down and select a single screw or a couple of screws from the pocketless screw holder, as the same are held in an open manner.

While the foregoing description and figures illustrate preferred embodiments of the pocketless screw holder in accordance with the present invention, it should be appreciated that certain modifications can be made and are encouraged to be made in the materials used as well as the structural and functional aspects of the invention without departing from the scope and spirit of the present invention which is defined by the claims which are set forth immediately hereafter.

I claim:

1. A pocketless device for holding and catching fasteners or tools accessible to a working craftsman, comprising:

a. a substantially thin and planar substrate;

b. means for securing said substrate in a location conveniently accessible to a working craftsman;

c. a magnetic material attached to said substrate, which magnetic material is adapted to hold a group of metal fasteners in a substantially vertical position such that the fasteners are in an open arrangement in such group and are openly accessible to a working craftsman; and d. catching means adapted to catch fastener which might fall from said magnetic material, wherein said catching means is arranged to be spaced from fasteners held on the magnetic material and not to serve as a support for fasteners when fasteners are held on the magnetic material, and wherein said catching means is arranged so that fasteners remain in a location openly accessible to a working craftsman even if fasteners fall and are caught by said catching means.

2. The device in claim 1, wherein said magnetic material is substantially thin and planar.

3. The device in claim 1, wherein said catching means is a flange member extending outwardly from the substantially planar substrate and extending below the magnetic material.

4. The device in claim 3, wherein said flange member is arcuate and continuous.

5. A method of holding and selecting fasteners or tools accessible to a working craftsman, comprising the steps of:

a. providing a magnetic holding material which is capable of holding tools or a group of fasteners in an open arrangement which is openly accessible to a working craftsman, even where the magnetic holding material is in a substantially vertical position, and arranging the magnetic holding material in a location accessible to a working craftsman;

b. providing means for catching fasteners which might fall from the magnetic holding material, and arranging the catching means below said magnetic holding material;

c. arranging tools or a group of fasteners on the magnetic holding material wherein the fasteners are spaced from the catching means such that the tools or fasteners are held in an open arrangement in a group and are openly accessible to a working craftsman;

d. selecting tools or fasteners from the open arrangement of the fasteners on the magnetic holding material for use while working;

e. permitting any fasteners which might fall from the magnetic holding material to be caught on the catching means and to temporarily remain on the catching means, whereat the fasteners remain openly accessible to the worker; and f. selecting any tools or fasteners which fall into an openly accessible position on the catching means.

6. The device in claim 5, wherein said magnetic material is substantially thin and planar.

7. The device in claim 5, wherein said catching means is a flange member extending outwardly from the substantially planar substrate and extending below the magnetic holding material.

8. The device in claim 7, wherein said flange member is arcuate and continuous.

* * * * *

UNITED STATES PATENT AND TRADEMARK OFFICE

CERTIFICATE OF CORRECTION

PATENT NO. : 5,758,807

DATED : June 2, 1998

INVENTOR(S) : Wright

It is certified that error appears in the above-identified patent and that said Letters Patent is hereby corrected as shown below:

Column 5, line 13 "fastener" should read --fasteners--.

Signed and Sealed this

Fifteenth Day of September, 1998

*Attest:*

Bruce Lehman

BRUCE LEHMAN

*Attesting Officer*

*Commissioner of Patents and Trademarks*